US011042110B1

(12) United States Patent
Kuwabara et al.

(10) Patent No.: US 11,042,110 B1
(45) Date of Patent: Jun. 22, 2021

(54) IMAGE FORMING APPARATUS

(71) Applicant: FUJIFILM Business Innovation Corp., Tokyo (JP)

(72) Inventors: Jun Kuwabara, Kanagawa (JP); Yoshiyuki Tominaga, Kanagawa (JP); Masaaki Yamaura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/944,507

(22) Filed: Jul. 31, 2020

(30) Foreign Application Priority Data

Mar. 23, 2020 (JP) ..... JP2020-051627

(51) Int. Cl.
*G03G 15/00* (2006.01)
*G03G 15/16* (2006.01)
*G03G 15/01* (2006.01)

(52) U.S. Cl.
CPC ..... *G03G 15/55* (2013.01); *G03G 15/0115* (2013.01); *G03G 15/1695* (2013.01); *G03G 15/5016* (2013.01); *G03G 15/6567* (2013.01)

(58) Field of Classification Search
CPC ..... G03G 15/0115; G03G 15/1695; G03G 15/5016; G03G 15/6567
See application file for complete search history.

(56) References Cited

U.S. PATENT DOCUMENTS 9,465,342 B2 * 10/2016 Fukami ..... G03G 15/553
10,895,829 B1 * 1/2021 Kuwabara ..... G03G 15/0131

FOREIGN PATENT DOCUMENTS

JP 2006-221106 A 8/2006
JP 2006-251138 A 9/2006
JP 6340927 B2 6/2018

* cited by examiner

*Primary Examiner* — Hoang X Ngo
(74) *Attorney, Agent, or Firm* — Sughrue Mion, PLLC

(57) ABSTRACT

An image forming apparatus includes an image carrier unit, an image display control unit, and a forming unit. The image carrier unit holds images formed from a developer. The images include an image intended to be transferred to a medium and an image unintended to be transferred to the medium. The image display control unit causes a display unit to display an image asking whether the image unintended to be transferred is to be formed when a predetermined condition for forming the image unintended to be transferred is satisfied. The forming unit forms the image unintended to be transferred to the medium when a command of forming the image unintended to be transferred to the medium is input to a display on the display unit.

20 Claims, 11 Drawing Sheets

IMAGE FORMING APPARATUS

CROSS-REFERENCE TO RELATED APPLICATIONS

This application is based on and claims priority under 35 USC 119 from Japanese Patent Application No. 2020-051627 filed Mar. 23, 2020.

BACKGROUND

(i) Technical Field

The present disclosure relates to an image forming apparatus.

(ii) Related Art

For an image forming apparatus such as a copying machine, a printer, or a FAX machine, technologies for forming images unintended to be transferred to a medium are described in Japanese Patent No. 6340927 (claims, [0038] to [0053], and FIG. 6), Japanese Unexamined Patent Application Publication No. 2006-251138 ([0043] to [0050], and FIG. 4), and Japanese Unexamined Patent Application Publication No. 2006-221106 (claims, [0023] to [0032], and FIG. 2).

Japanese Patent No. 6340927 describes a technology of forming a belt-like toner image in a non-image area between toner images to compulsorily consume toner degraded through agitation and left in a developing device (14) without being consumed. When a recording medium has a width smaller than the maximum width, the technology described in Japanese Patent No. 6340927 increases the image density of the belt-like toner image or increases the length of the image to increase the consumption of degraded toner.

Japanese Unexamined Patent Application Publication No. 2006-251138 describes a technology of forming toner bands in an area other than an image forming area in such a manner that a thin toner band is formed when a printed image is dense, and a thick toner band is formed when a printed image is thin to feed a constant amount of toner to a cleaning device (18).

Japanese Unexamined Patent Application Publication No. 2006-221106 describes a technology of forming, in a monochrome image forming mode, toner bands on photoconductor drums on which no image is formed to keep the lubricity of cleaning blades, and increasing the amount of toner of the toner band on the photoconductor drum located most upstream.

SUMMARY

Aspects of non-limiting embodiments of the present disclosure relate to improvement of productivity compared to a case where a toner band is uniformly formed when a condition for restoring the transfer performance of an image carrier unit is satisfied.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus that includes an image carrier unit, an image display control unit, and a forming unit. The image carrier unit holds images formed from a developer. The images include an image intended to be transferred to a medium and an image unintended to be transferred to the medium. The image display control unit causes a display unit to display an image asking whether the image unintended to be transferred is to be formed when a predetermined condition for forming the image unintended to be transferred is satisfied. The forming unit forms the image unintended to be transferred to the medium when a command of forming the image unintended to be transferred to the medium is input to a display on the display unit.

BRIEF DESCRIPTION OF THE DRAWINGS

Exemplary embodiments of the present disclosure will be described in detail based on the following figures, wherein:

FIG. 5A illustrates an image for asking a user whether an image unintended to be transferred is to be formed, FIG. 5B illustrates an image for setting the amount of a developer used as an image unintended to be transferred, and FIG. 5C illustrates an image according to a modification example;

FIG. 6A illustrates an image forming area and a no-image-formed area, FIG. 6B illustrates toner-feed images on the intermediate transfer belt while rotating an odd-numbered cycle, and FIG. 6C illustrates toner-feed images on the intermediate transfer belt while rotating an even-numbered cycle;

FIG. 8A illustrates an example of a low-sensitive sheet, FIG. 8B illustrates an example of an embossed sheet, and FIG. 8C illustrates an example of a Japanese paper sheet;

FIG. 11A illustrates a case where toner-feed images correspond to all the images intended to be transferred, FIG. 11B illustrates a case where a toner-feed image is also formed at a position different from an image intended to be transferred, and FIG. 11C illustrates a case where toner-feed images correspond to part of images intended to be transferred.

DETAILED DESCRIPTION

With reference to the drawings, specific examples (referred to as examples, below) of exemplary embodiments of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are omitted as appropriate for ease of understanding.

Example 1

Figure 1:
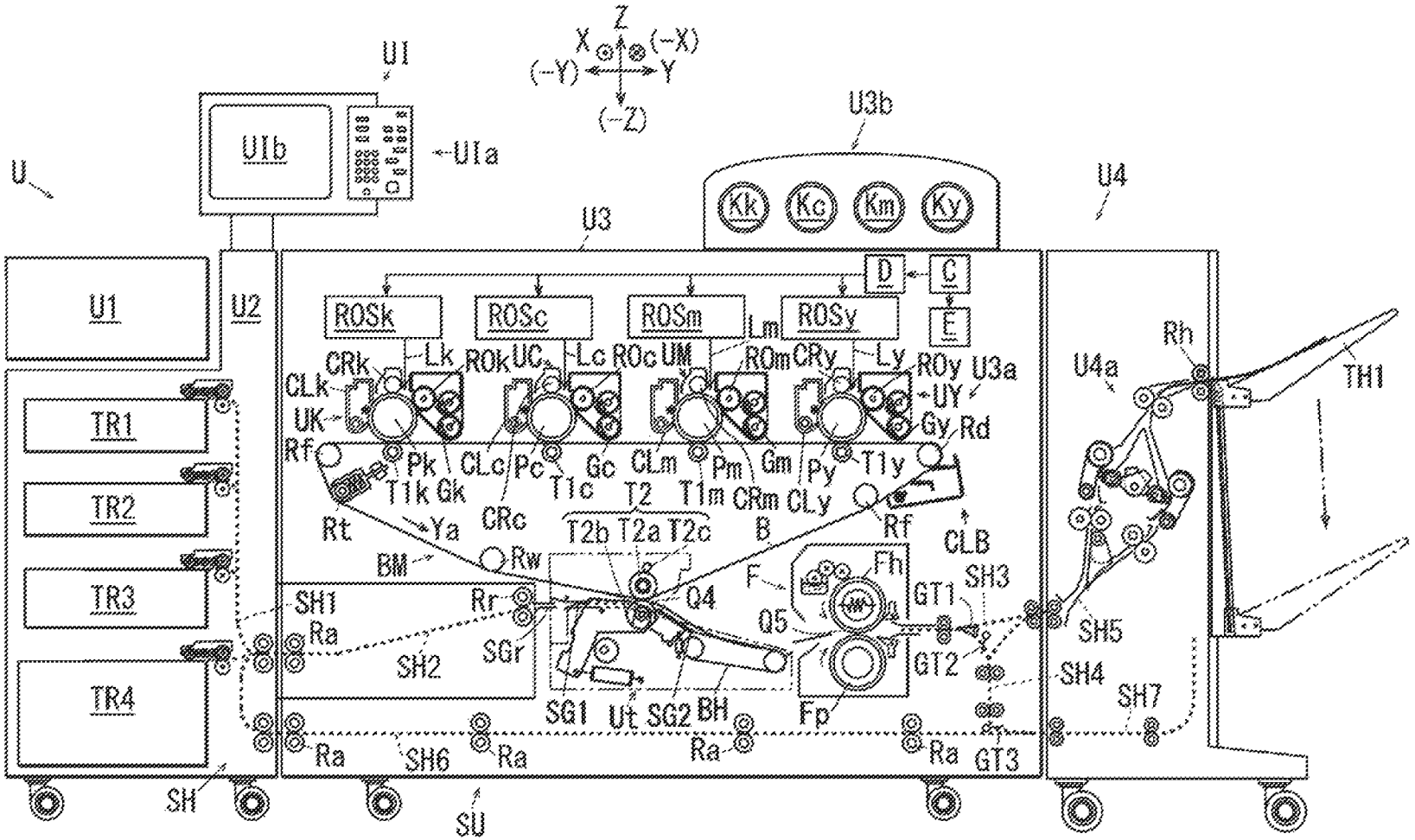
FIG. 1 illustrates the entirety of an image forming apparatus according to an example 1.

FIG. 1 illustrates the entirety of an image forming apparatus according to an example 1 of the present disclosure.

Figure 2:
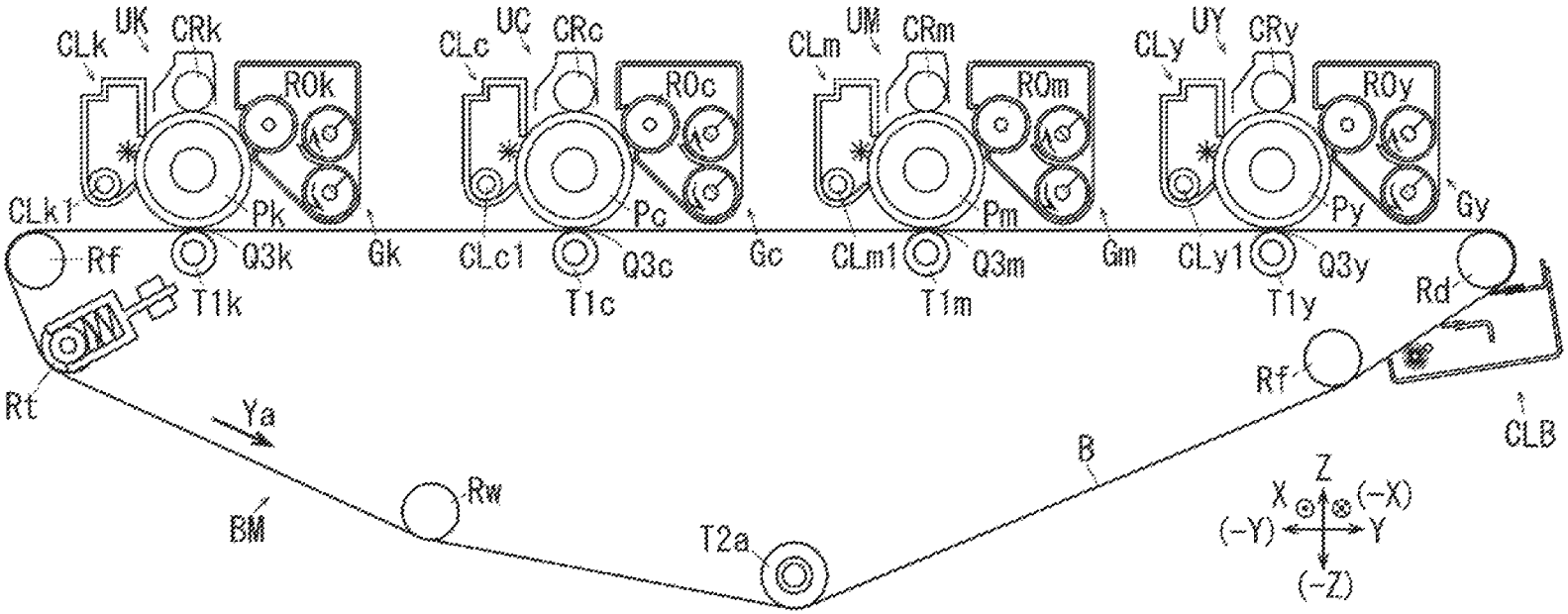
FIG. 2 is an enlarged view of a visible-image forming apparatus according to the example 1.

FIG. 2 is an enlarged view of a visible-image forming apparatus according to the example 1.

In FIG. 1, a copying machine U, serving as an example of an image forming apparatus, includes a user interface UI, serving as an example of an operation unit, a scanning unit U1, serving as an example of an image reading unit, a feeder unit U2, serving as an example of a medium feeder, an image forming unit U3, serving as an example of an image recording device, and a medium processing device U4.

Description of User Interface UI

The user interface UI includes an input button UIa, used to start copying or setting the number of sheets to be copied. The user interface UI includes a display unit UIb, which displays the contents input through the input button UIa or the state of the copying machine U.

Description of Feeder Unit U2

In FIG. 1, the feeder unit U2 includes sheet feeding trays TR1, TR2, TR3, and TR4, serving as examples of a medium container. The feeder unit U2 also includes a medium feed path SH1. Along the medium feed path SH1, recording sheets S, which are accommodated in and picked up from the sheet feeding trays TR1 to TR4, are transported to the image forming unit U3. The recording sheets S are examples of media for image recording.

Description of Image Forming Unit U3 and Medium Processing Device U4

In FIG. 1, the image forming unit U3 includes an image recording unit U3*a*, which records images on the recording sheets S transported from the feeder unit U2 based on a document image read by the scanning unit U1.

In FIGS. 1 and 2, a driving circuit D of a latent-image forming device of the image forming unit U3 outputs driving signals corresponding to image information input from the scanning unit U1 to latent-image forming devices ROSy, ROSm, ROSc, and ROSk for the corresponding colors Y, M, C, and K at predetermined timing. Below the latent-image forming devices ROSy to ROSk, photoconductor drums Py, Pm, Pc, and Pk, which are examples of image carriers, are disposed.

The surfaces of the rotating photoconductor drums Py, Pm, Pc, and Pk are uniformly charged by charging rollers CRy, CRm, CRc, and CRk, which are examples of charging devices. The photoconductor drums Py to Pk having their surfaces charged allow electrostatic latent images to be formed on their surfaces by laser beams Ly, Lm, Lc, and Lk, serving as examples of latent-image writing light beams output by the latent-image forming devices ROSy, ROSm, ROSc, and ROSk. The electrostatic latent images on the surfaces of the photoconductor drums Py, Pm, Pc, and Pk are developed by developing devices Gy, Gm, Gc, and Gk into toner images of yellow Y, magenta M, cyan Y, and black K, which are examples of visible images.

The developing devices Gy to Gk receive an amount of a developer corresponding to the amount consumed through development from toner cartridges Ky, Km, Kc, and Kk, which are examples of developer containers. The toner cartridges Ky, Km, Kc, and Kk are detachably attached to a developer dispenser U3*b*.

The toner images on the surfaces of the photoconductor drums Py, Pm, Pc, and Pk are sequentially superposed on and transferred to an intermediate transfer belt B, serving as an example of an intermediate transfer body, in first transfer areas Q3*y*, Q3*m*, Q3*c*, and Q3*k* by first transfer rollers T1*y*, T1*m*, T1*c*, and T1*k*, serving as examples of first transfer members, so that a color toner image, which is an example of a multicolor visible image, is formed on the intermediate transfer belt B. The color toner image formed on the intermediate transfer belt B is transported to a second transfer area Q4.

In the case of using only black image information, the photoconductor drum Pk and the developing device Gk for black K are only used to form only a toner image for the color K.

After first transfer, remnants such as a remaining developer or paper dust adhering to the surfaces of the photoconductor drums Py, Pm, Pc, and Pk are removed by drum cleaners CLy, CLm, CLc, and CLk, which are examples of cleaners for image carriers.

In the example 1, the photoconductor drum Pk, the charging roller CRk, and the drum cleaner CLk are integrated into a photoconductor unit UK for the color K, which is an example of an image carrier unit. Similarly, for other colors Y, M, and C, the photoconductor drums Py, Pm, and Pc, the charging rollers CRy, CRm, and CRc, and the drum cleaners CLy, CLm, and CLc form photoconductor units UY, UM, and UC.

The photoconductor unit UK and the developing device Gk including the development roller ROk, which is an example of a developer holder, for the color K form a visible-image forming apparatus UK+Gk for the color K. Similarly, the photoconductor units UY, UM, and UC and the developing devices Gy, Gm, and Gc including the development rollers ROy, ROm, and ROc for the colors Y, M, and C form visible-image forming apparatuses UY+Gy, UM+Gm, and UC+Gc for the colors Y, M, and C.

A belt module BM, serving as an example of an intermediate transfer member, is disposed below the photoconductor drums Py to Pk. The belt module BM includes an intermediate transfer belt B, serving as an example of an image carrier unit, a driving roller Rd, serving as an example of a member driving an intermediate transfer body, a tension roller Rt, serving as an example of a tensioning member, a walking roller Rw, serving as an example of a weaving prevention member, multiple idler rollers Rf, serving as examples of driven members, a back-up roller T2*a*, serving as an example of an opposing member, and first transfer rollers T1*y*, T1*m*, T1*c*, and T1*k*. The intermediate transfer belt B is supported to be rotatable in the direction of arrow Ya.

A second transfer unit Ut is disposed below the back-up roller T2*a*. The second transfer unit Ut includes a second transfer roller T2*b*, serving as an example of a second transfer member. The area over which the second transfer roller T2*b* comes into contact with the intermediate transfer belt B forms a second transfer area Q4. The second transfer roller T2*b* is disposed on the side of the intermediate transfer belt B across from the back-up roller T2*a*, which is an example of an opposing member. A contract roller T2*c*, serving as an example of a power feeder, is in contact with the back-up roller T2*a*. The contract roller T2*c* receives a second transfer voltage having a polarity the same as that with which toner is charged.

The back-up roller T2*a*, the second transfer roller T2*b*, and the contract roller T2*c* form a second transfer device T2, serving as an example of a second transfer member.

A medium transport path SH2 is disposed below the belt module BM. The recording sheets S fed from the sheet feeding path SH1 of the feeder unit U2 are transported to registration rollers Rr, which are examples of members that adjust transport timing, by transport rollers Ra, serving as examples of medium transport members. The registration rollers Rr transport the recording sheets S downstream at the right timing when a toner image formed on the intermediate transfer belt B is transported to the second transfer area Q4. The recording sheet S transported by the registration rollers Rr is guided by a sheet guide SGr in front of the registration rollers and a sheet guide SG1 before transfer to a second transfer area Q4.

The toner image on the intermediate transfer belt B is transferred to the recording sheet S by the second transfer device T2 while passing the second transfer area Q4. In the case of forming a color toner image, toner images superposed on and first-transferred to the surface of the intermediate transfer belt B are collectively second-transferred to the recording sheet S.

The first transfer rollers T1*y* to T1*k*, the second transfer device T2, and the intermediate transfer belt B form a transfer device T1*y*-T1*k*+T2+B of the example 1.

The intermediate transfer belt B after the second transfer is cleaned by a belt cleaner CLB, serving as an example of an intermediate-transfer-body cleaner, disposed downstream of the second transfer area Q4. The belt cleaner CLB, serving as an example of a remover, removes remnants in the second transfer area Q4, such as paper dust or a developer left without being transferred, from the intermediate transfer belt B.

The recording sheet S to which a toner image has been transferred is guided by a sheet guide SG2 after the transfer, and transported to a medium transport belt BH, serving as an example of a medium transport device. The medium transport belt BH transports the recording sheet S to a fixing device F.

The fixing device F includes a heating roller Fh, serving as an example of a heating member, and a pressing roller Fp, serving as an example of a pressing member. The recording sheet S is transported to a fixing area Q5, where the heating roller Fh and the pressing roller Fp are in contact with each other. While passing the fixing area Q5, the toner image on the recording sheet S is heated and pressed by the fixing device F to be fixed to the recording sheet S.

The visible-image forming apparatuses UY+Gy to UK+Gk, the transfer device T1*y*-T1*k*+T2+B, and the fixing device F form the image recording unit U3*a*, serving as an example of an image forming member of the example 1.

A switching gate GT1, serving as an example of a switching member, is disposed downstream of the fixing device F. The switching gate GT1 selectively switches a path for the recording sheet S passing the fixing area Q5, between a sheet discharge path SH3 and a sheet reverse path SH4 of the medium processing device U4. The recording sheet S transported to the sheet discharge path SH3 is transported to a medium transport path SH5 of the medium processing device U4. A curl correction member U4*a*, serving as an example of a warp correction member, is disposed on the medium transport path SH5. The curl correction member U4*a* corrects warpage, or so-called a curl of the recording sheet S transported thereto. The recording sheet S having its curl corrected is discharged to a discharge tray TH1, serving as an example of a medium discharge portion, with discharge rollers Rh, serving as examples of medium discharge members, while having its image fixed surface facing up.

The recording sheet S transported to the reversing path SH4 of the image forming unit U3 by the switching gate GT1 is transported through a second gate GT2, serving as an example of a switching member, to the reversing path SH4 of the image forming unit U3.

Here, when the recording sheet S is to be discharged while having its image fixed surface facing down, the transport direction of the recording sheet S is reversed after the trailing end of the recording sheet S in the transport direction passes the second gate GT2. Here, the second gate GT2 according to the example 1 is formed from a thin elastic member. Thus, the second gate GT2 allows the recording sheet S transported to the reversing path SH4 to pass therethrough once, and then guides the recording sheet S that has passed therethrough and then reversed or transported backward to the transport paths SH3 and SH5. The recording sheet S transported backward passes the curl correction member U4*a*, and is discharged to the discharge tray TH1 while having its image fixed surface facing down.

A circuit SH6 is connected to the reversing path SH4 of the image forming unit U3, and a third gate GT3, serving as an example of a switching member, is disposed at the connection portion. A downstream end of the reversing path SH4 is connected to a reversing path SH7 of the medium processing device U4.

The recording sheet S transported through the switching gate GT1 to the reversing path SH4 is allowed by the third gate GT3 to be transported to the reversing path SH7 of the medium processing device U4. As in the case of the second gate GT2, the third gate GT3 according to the example 1 is formed from a thin elastic member. Thus, the third gate GT3 allows the recording sheet S transported from the reversing path SH4 to pass therethrough once, and guides the recording sheet S that has passed therethrough and has been transported backward, to the circuit SH6.

The recording sheet S transported to the circuit SH6 is transported again to the second transfer area Q4 through the medium transport path SH2 to have its second surface subjected to printing.

Components denoted with the reference signs SH1 to SH7 form the medium transport path SH. The components denoted with the reference signs SH, Ra, Rr, Rh, SGr, SG1, SG2, BH, and GT1 to GT3 form a sheet transport device SU according to the example 1.

Description of Controller of Example 1

Figure 3:
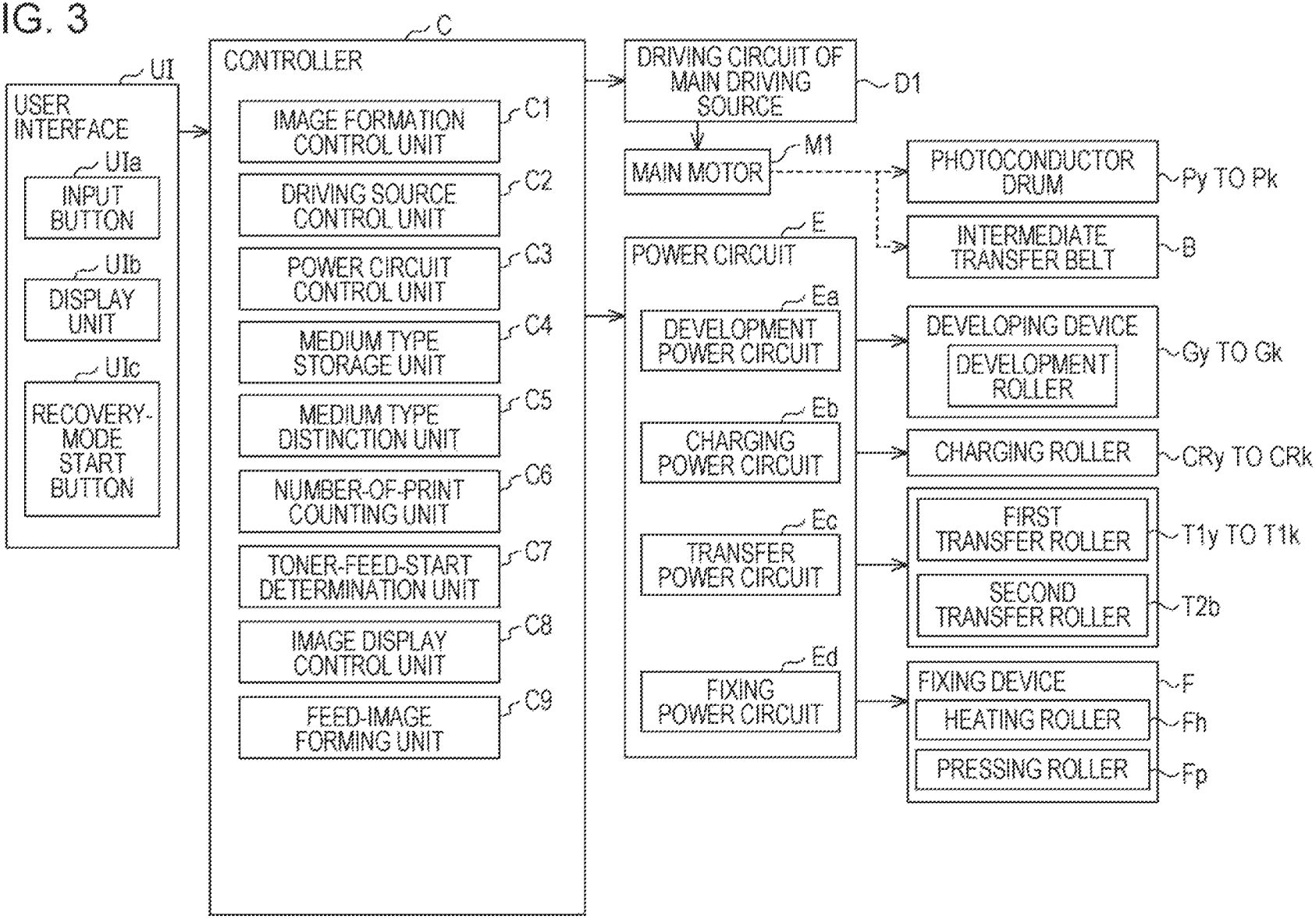
FIG. 3 is a block diagram of the functions of a controller of an image forming apparatus according to the example 1.

FIG. 3 is a block diagram of the functions of a controller of an image forming apparatus according to the example 1.

In FIG. 3, a controller C, serving as an example of a controlling member of the copying machine U, includes an input/output interface I/O for inputting or outputting signals from or to external devices. The controller C also includes a read only memory (ROM) storing, for example, programs and information for performing intended processes. The controller C also includes a random access memory (RAM)

temporarily storing intended data. The controller C also includes a central processing unit (CPU) performing processes according to programs stored in, for example, the ROM. Thus, the controller C of the example 1 is formed from a small information processor, or a so-called microcomputer. Thus, the controller C is capable of implementing various functions by executing programs stored in, for example, the ROM.

Signal Output Component Connected to Controller C

The controller C receives signals output from a signal output component such as the user interface UI.

The user interface UI includes, as examples of input members, an input button UIa for inputting, for example, a copy-start key, numeric keys, or arrows, a display unit UIb, serving as an example of a display member, and a recovery-mode start button UIc, which receives an input of starting a recovery mode.

The recovery-mode start button UIc allows a user to input an execution of a recovery mode, which is an operation of forming a toner-feed image on an intermediate transfer belt B, serving as an example of an image carrier unit. The toner-feed image is an image unintended to be transferred to a recording sheet S.

The input button UIa or the recovery-mode start button UIc are not limited to be in a hardware button form, and may be in a form of image buttons displayed on the display unit UIb, which receives inputs, such as a touch screen.

To-Be-Controlled Component Connected to Controller C

The controller C is connected to a driving circuit D1 of a main driving source, a power circuit E, and other control components, not illustrated. The controller C outputs control signals to those circuits D1 and E.

D1: Driving Circuit Serving as Main Driving Source

The driving circuit D1 of a main driving source rotates and drives, for example, the photoconductor drums Py to Pk and the intermediate transfer belt B via a main motor M1, serving as an example of a main driving source.

E: Power Circuit

The power circuit E includes a development power circuit Ea, a charging power circuit Eb, a transfer power circuit Ec, and a fixing power circuit Ed.

Ea: Development Power Circuit

The development power circuit Ea applies a development voltage to the development rollers of the developing devices Gy to Gk.

Eb: Charging Power Circuit

The charging power circuit Eb applies a charging voltage to the charging rollers CRy to CRk for electrically charging the surfaces of the photoconductor drums Py to Pk.

Ec: Transfer Power Circuit

The transfer power circuit Ec applies a transfer voltage to the first transfer rollers Tly to Tlk and the back-up roller T2*a*.

Ed: Fixing Power Circuit

The fixing power circuit Ed feeds power to a heater of the heating roller Fh of the fixing device F.

Functions of Controller C

The controller C has a function of performing processes corresponding to input signals from the signal output component and outputting control signals to the control components. Specifically, the controller C has the following functions.

C1: Image Formation Control Unit

An image formation control unit C1 controls driving of components of the scanner unit U1 or the image forming unit U3 or timing of voltage application in accordance with inputs to the user interface UI or inputs of image information from external personal computers or other devices to execute a job, which is an image forming operation.

C2: Driving Source Control Unit

The driving source control unit C2 controls driving of the main motor M1 via the driving circuit D1 of a main driving source to control driving of, for example, the photoconductor drums Py to Pk.

C3: Power Circuit Control Unit

The power circuit control unit C3 controls the power circuits Ea to Ed to control a voltage applied to each component or power fed to each component.

C4: Medium Type Storage Unit

The medium type storage unit C4 stores types of recording sheets S, serving as examples of media used. The medium type storage unit C4 of the example 1 stores types of the recording sheets S accommodated in the sheet feeding trays TR1 to TR4 of the feeder unit U2 for each of the sheet feeding trays TR1 to TR4. In the example 1, the medium type storage unit C4 of the example 1 stores the types of the recording sheets S accommodated in the sheet feeding trays TR1 to TR4 that have been set and registered with inputs through the user interface UI. The types of the recording sheets S may be set by being selected from among, for example, "thin sheet", "ordinary sheet", "thick sheet", "embossed sheet", "Japanese paper sheet", and "coated sheet", or may be set through a direct input of, for example, "sheet basis weight".

C5: Medium Type Distinction Unit

A medium type distinction unit C5 distinguishes the types of the recording sheets S used for printing. The medium type distinction unit C5 of the example 1 distinguishes the types of the recording sheets S based on the information of the types of the recording sheets S in the sheet feeding trays TR1 to TR4 stored in the medium type storage unit C4 and the sheet feeding trays TR1 to TR4 used for printing. The medium type distinction unit C5 of the example 1 also identifies if the sheet used for printing is any of an embossed sheet and a Japanese paper sheet, which are examples of a highly transfer-sensitive medium, or any of a thin sheet, an ordinary sheet, an thick sheet, and a coated sheet, which are examples of a medium with low transfer sensitivity.

"Transfer sensitivity" in the description and the scope of claims refers to the transfer difficulty of an image to a recording sheet S, or conversely, transferability. Media susceptible to changes of environments such as the temperature or humidity or applied voltage, or changes of transfer speed or other factors to cause transfer errors are referred to as "having high transfer sensitivity", and media less likely to cause transfer errors are referred to as "having low transfer sensitivity". Thin sheets, ordinary sheets, thick sheets, and coated sheets having a flat surface with substantially uniform density of fiber such as pulp have low transfer sensitivity. On the other hand, embossed sheets formed by embossing to have an uneven surface and Japanese paper sheets (low-density media) formed from a material such as pulp at an uneven density and containing many gaps compared with an ordinary sheet have high transfer sensitivity. Although described with reference to FIGS. 8A to 8C, below, the embossed sheets and Japanese paper sheets have high transfer sensitivity because transfer errors are likely to be attributable to variation of the transfer voltage caused when, at an application of a transfer voltage, a recess or a gap (portion without fiber) and a portion with fiber have different electrical resistance or an electric discharge occurs in a recess or a gap.

In the following description, embossed sheets and Japanese paper sheets may be collectively referred to as "highly-sensitive sheets" as examples of first media, and ordinary sheets and other sheets with flat surfaces may be referred to as "low-sensitive sheets" as examples of second media.

The example 1 has described a case where the types of media are distinguished based on information stored in the medium type storage unit C4, but this is not the only possible example. For example, a sensor may be installed at the sheet feeding trays TR1 to TR4 of the feeder unit U2 or on the transport paths SH1 and SH2 from the sheet feeding trays TR1 to TR4 to the registration rollers Rr to detect and distinguish the types of the recording sheets S used for printing. The sensor is an example of a detection member that detects the type of a medium with properties such as thickness, light transmittance, light reflectance, polarization property, and surface roughness of the medium. Thus, for example, when a recording sheet S detected by the sensor has a surface roughness higher than a predetermined value (threshold), that is, when the recording sheet S has large unevenness, the recording sheet S is determined as a highly-sensitive sheet. When a recording sheet S detected by the sensor has a density (=weight/(thickness×area)) smaller than a predetermined value (threshold), that is, when the recording sheet S contains many gaps inside, the recording sheet S is determined as a highly-sensitive sheet.

Instead, for example, a sensor may distinguish the type of the medium by reading a barcode (identification) appended to a wrapping of a medium.

C6: Number-of-Print Counting Unit

A number-of-print counting unit C6, serving as an example of a counting unit for counting the number of transfer, counts the number of prints as a number of times of transfer. Specifically, the number-of-print counting unit C6 counts how many times a print image, serving as an example of an image intended to be transferred, is transferred to the recording sheets S. In the example 1, when a toner-feed image, serving as an example of an image unintended to be transferred, is formed, the number of prints is initialized, or reset. The image unintended to be transferred will be described below.

C7: Toner-Feed-Start Determination Unit (Unit for Determining Conditions for Forming Images Unintended to be Transferred)

A toner-feed-start determination unit C7 determines whether it is time for forming a toner-feed image, that is, whether a condition for forming an image unintended to be transferred is satisfied. The toner-feed-start determination unit C7 of the example 1 determines that it is time for forming a toner-feed image, serving as an example of an image unintended to be transferred, when a predetermined condition for feeding toner, serving as an example of a developer, onto the surface of the intermediate transfer belt B is satisfied. For example, the toner-feed-start determination unit C7 determines that it is time for forming a toner-feed image when a highly-sensitive sheet such as an embossed sheet is used. Specifically, when the copying machine U receives a print command for forming a print image (image intended to be transferred) on a highly-sensitive sheet, the toner-feed-start determination unit C7 determines that it is time for forming a toner-feed image.

Figure 4:
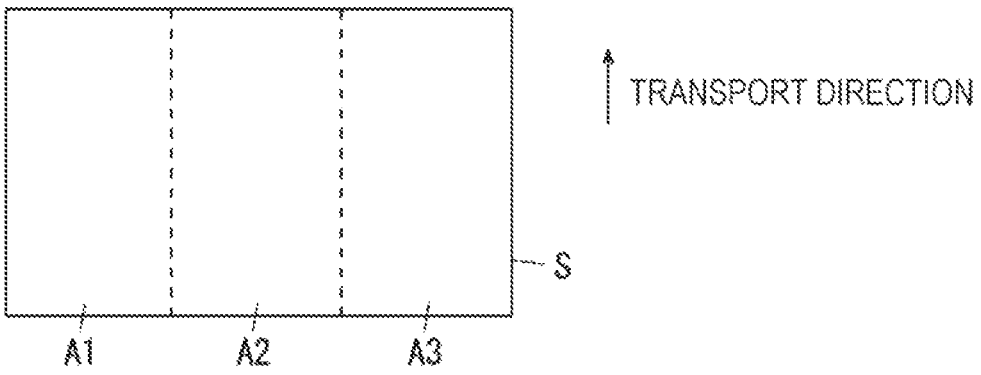
FIG. 4 illustrates image areas for identifying image density of the example 1.

FIG. 4 illustrates image areas for determining image density of the example 1.

The toner-feed-start determination unit C7 of the example 1 determines whether the condition for forming a toner-feed image is satisfied based on an average area coverage of an image printed through job execution, that is, an average area coverage based on the record of formerly formed images intended to be transferred. In the example 1, when the average area coverage of an image, serving as an example of toner consumption information, fails to arrive at a predetermined threshold, the toner-feed-start determination unit C7 determines that the condition for forming a toner-feed image is satisfied. For example, when the average area coverage of 50 sheets printed in the past fails to arrive at 3%, the toner-feed-start determination unit C7 determines that it is time for forming a toner-feed image. The average area coverage is derived by calculating the ratio of the number of pixels occupied to the total number of pixels in a target image area.

In FIG. 4, the toner-feed-start determination unit C7 of the example 1 determines that the condition for forming a toner-feed image is satisfied when a difference in average area coverage between multiple areas A1 to A3 of the recording sheet S arranged in the width direction of the recording sheet S arrives at a predetermined threshold. The average area coverage serves as an example of toner consumption information in the areas A1 to A3. For example, the toner-feed-start determination unit C7 determines that it is time for forming a toner-feed image when the maximum density and the minimum density of the average area coverage of the past 50 sheets individually derived for the three areas A1 to A3 have a density difference (density gradient) of higher than or equal to 5%.

A specific number of sheets or a specific threshold may be changed as appropriate in accordance with properties such as design, specifications, or the sensitivity of the sheet used. The number of sheets based on which the entire average area coverage or the density difference for the areas A1 to A3 is determined may be changed. Instead of performing determination based on the average area coverage for all the sheet types, determination may be performed only on a highly-sensitive sheet.

The toner-feed-start determination unit C7 of the example 1 determines that it is time for forming a toner-feed image also when the recovery-mode start button UIc receives an input. Thus, in the example 1, examples of a case where a condition for forming a toner-feed image is satisfied include four cases, that is, a case where a highly-sensitive sheet is used, a case where the entire average area coverage of the recording sheet S in the areas A1 to A3 is low, a case where the difference in average area coverage of the areas A1 to A3 is large, and a case where the recovery-mode start button UIc receives an input.

Figure 5A:
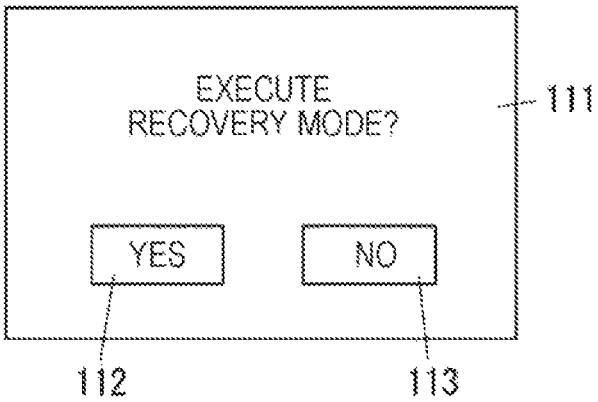
FIGS. 5A to 5C illustrate display images of the example 1, where
Figure 5B:
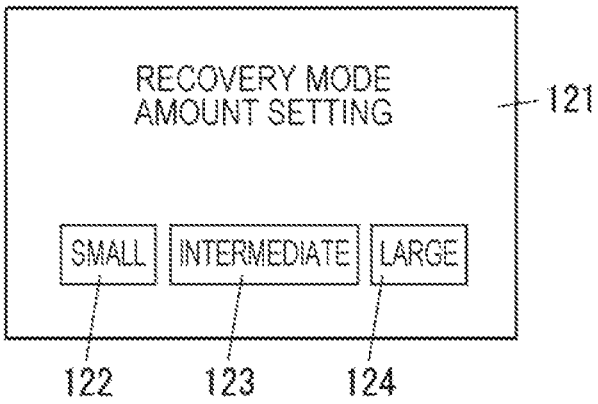
Figure 5C:
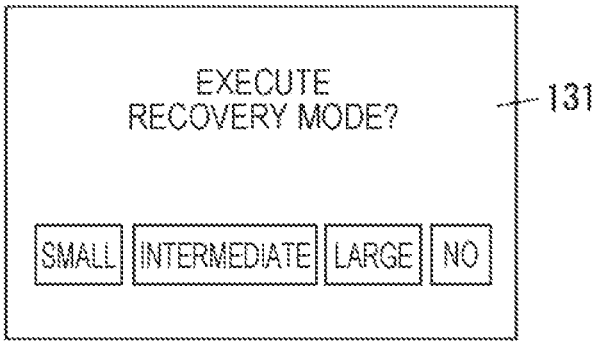

FIGS. 5A and 5B illustrate display images of the example 1, where FIG. 5A illustrates an image for asking a user whether an image unintended to be transferred is to be formed, FIG. 5B illustrates an image for setting the amount of the developer used for an image unintended to be transferred, and FIG. 5C illustrates an image according to a modification example.

C8: Image Display Control Unit

When the condition for forming a toner-feed image is satisfied, an image display control unit C8 causes the display unit UIb to display a question image 111, serving as an example of an image for asking a user whether a toner-feed image is to be formed. In FIG. 5A, the question image 111 of the example 1 is an image for asking a user whether "recovery mode" is to be executed. The "recovery mode" is an example of an operation for forming a toner-feed image. The question image 111 includes an execution button 112, which receives an input for executing a recovery mode, and a nonexecution button 113, which receives an input for nonexecution of the recovery mode.

The image display control unit C8 of the example 1 causes the display unit UIb to display an amount-set image 121, through which the amount (level of the recovery mode) of a developer used for a toner-feed image is set, when the condition for forming a toner-feed image is satisfied. In FIG. 5B, the amount-set image 121 of the example 1 includes a small-amount-set button (soft button) 122, an intermediate-amount-set button (medium button) 123, and a large-amount-set button (hard button) 124. The small-amount-set button (soft button) 122 is used to reduce the amount of the developer used as the toner-feed image in the recovery mode. The intermediate-amount-set button (medium button) 123 is used to set the amount of the developer used as the toner-feed image in the recovery mode to a medium level. The large-amount-set button (hard button) 124 is used to increase the amount of the developer used as the toner-feed image in the recovery mode.

In the example 1, the amount-set image 121 is displayed when the execution button 112 in the question image 111 receives an input.

As illustrated in FIGS. 5A and 5B, the question image 111 and the amount-set image 121 may be different images, but this is not the only possible example. For example, as illustrated in FIG. 5C, a single image 131 may enable selection of any of nonexecution of the recovery mode, and execution with any of different developer amount settings.

Figure 6A:
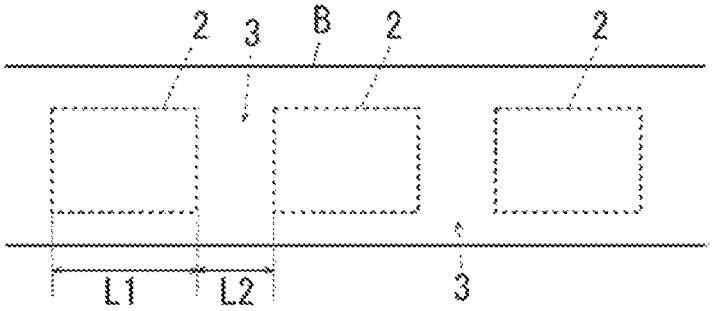
FIGS. 6A, 6B, and 6C illustrate examples of toner-feed images of the example 1, where
Figure 6B:
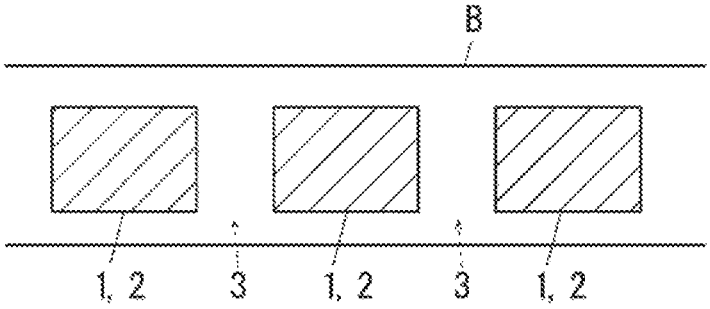
Figure 6C:
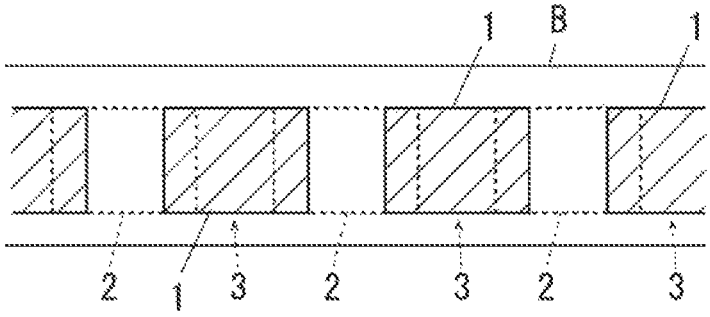

FIGS. 6A, 6B, and 6C illustrate examples of toner-feed images of the example 1, where FIG. 6A illustrates an image forming area and a no-image-formed area, FIG. 6B illustrates toner-feed images on the intermediate transfer belt while rotating an odd-numbered cycle, and FIG. 6C illustrates toner-feed images on the intermediate transfer belt while rotating an even-numbered cycle.

C9: Feed-Image Forming Unit (Example of Forming Unit)

A feed-image forming unit C9 forms toner-feed images 1, serving as an example of images unintended to be transferred. The feed-image forming unit C9 forms the toner-feed images 1 when the execution button 112 in the question image 111 receives an input, and any of the amount-set buttons 122 to 124 in the amount-set image 121 receives an input. The toner-feed images 1 are transferred to the intermediate transfer belt B, and removed with the belt cleaner CLB without being transferred to the recording sheet S.

As illustrated in FIG. 6B, compared with image areas 2, serving as image forming areas on the intermediate transfer belt B, and inter-image areas 3, serving as no-image-formed areas between the image areas 2, each toner-feed image 1 of the example 1 has the same size as that of the image area 2. Specifically, each toner-feed image 1 of the example 1 has a length the same as a length L1 of the image area 2, serving as an example of a predetermined length in a rotation direction of the intermediate transfer belt B. The toner-feed images 1 are formed at an interval the same as a length L2 of each inter-image area 3.

The feed-image forming unit C9 of the example 1 forms the toner-feed images 1 based on the amount of the developer set in accordance with the input to the corresponding one of the amount-set buttons 122 to 124. In the example 1, an increase or decrease of the area of the toner-feed images 1 to be formed increases or decreases the consumption of the developer. For example, when the small-amount-set button 122 receives an input, the toner-feed images 1 are formed while the intermediate transfer belt B rotates three cycles. When the intermediate-amount-set button 123 receives an input, the toner-feed images 1 are formed while the intermediate transfer belt B rotates five cycles. When the large-amount-set button 124 receives an input, the toner-feed images 1 are formed while the intermediate transfer belt B rotates seven cycles. The specific number of cycles the intermediate transfer belt B rotates for which the toner-feed images 1 are formed is not limited to any of the above specified numbers, and changeable in accordance with, for example, the design or specifications.

In the example 1, as illustrated in FIGS. 6B and 6C, in an odd-numbered cycle of the intermediate transfer belt B, the toner-feed images 1 are formed at portions of the intermediate transfer belt B corresponding to the image areas 2. In an even-numbered cycle of the intermediate transfer belt B, the toner-feed images 1 are formed at portions of the intermediate transfer belt B corresponding to the gaps between the toner-feed images 1 formed in an odd-numbered cycle, that is, at portions that cover (overlap) the inter-image areas 3. In the above structure, the image areas 2 are covered in an odd-numbered cycle, and the inter-image areas 3 are covered in an even-numbered cycle, but this is not the only possible example. For example, in a second cycle, the toner-feed images 1 may be formed at portions shifted by a distance (L1+L2)/3 from the portions in the first cycle, and in a third cycle, the toner-feed images 1 may be formed at portions shifted by a distance (L1+L2)/3 from the portions in the second cycle. One set may include three cycles instead of two cycles. Alternatively, one set may include, for example, four or five sets.

The feed-image forming unit C9 of the example 1 forms toner-feed images 1 with different densities on the basis of the amount of the developer set in accordance with an input to any of the amount-set buttons 122 to 124. In the example 1, an increase or decrease of the density of the toner-feed image 1 to be formed increases or decreases the consumption of the developer. For example, when the small-amount-set button 122 receives an input, the Y, M, C, and K toner-feed images 1 with a density of 25% each, or 100% in total, are formed. When the intermediate-amount-set button 123 receives an input, the Y, M, C, and K toner-feed images 1 with a density of 50% each, or 200% in total, are formed. When the large-amount-set button 124 receives an input, the Y, M, C, and K toner-feed images 1 with a density of 75% each, or 300% in total, are formed.

The density of the toner-feed images 1 is not limited to any of the above densities, and may be other density. The used colors of toner are not limited to four colors, and may be three or less. The used color of toner may be the one that degrades the most in the four colors, that is, the color (or colors) whose average area coverage is low. Here, the toner-feed images 1 are formed with toner that degrades the most to compulsorily consume the degrading toner to replace the degrading toner with a new lot of toner.

In the example 1, the case where the number of the toner-feed images 1 to be formed and the density are both changed in accordance with the settings through the amount-set image 121 is described by way of example, but this is not the only possible example. Either the number of the toner-feed images 1 to be formed or the density may be changed. For example, when a small amount or an intermediate-amount is specified, the density may be changed without changing the area, and when an intermediate-amount or a large amount is specified, the area may be changed without changing the density. Alternatively, images designed corresponding to the respective consumptions may be prepared, or the consumptions may be changed in accordance with factors other than the area and the density.

Flowchart of Example 1

Now, a control flow of the copying machine U of the example 1 will be described with a flowchart.

Flowchart of Toner-Feed Image Forming Process

Figure 7A:
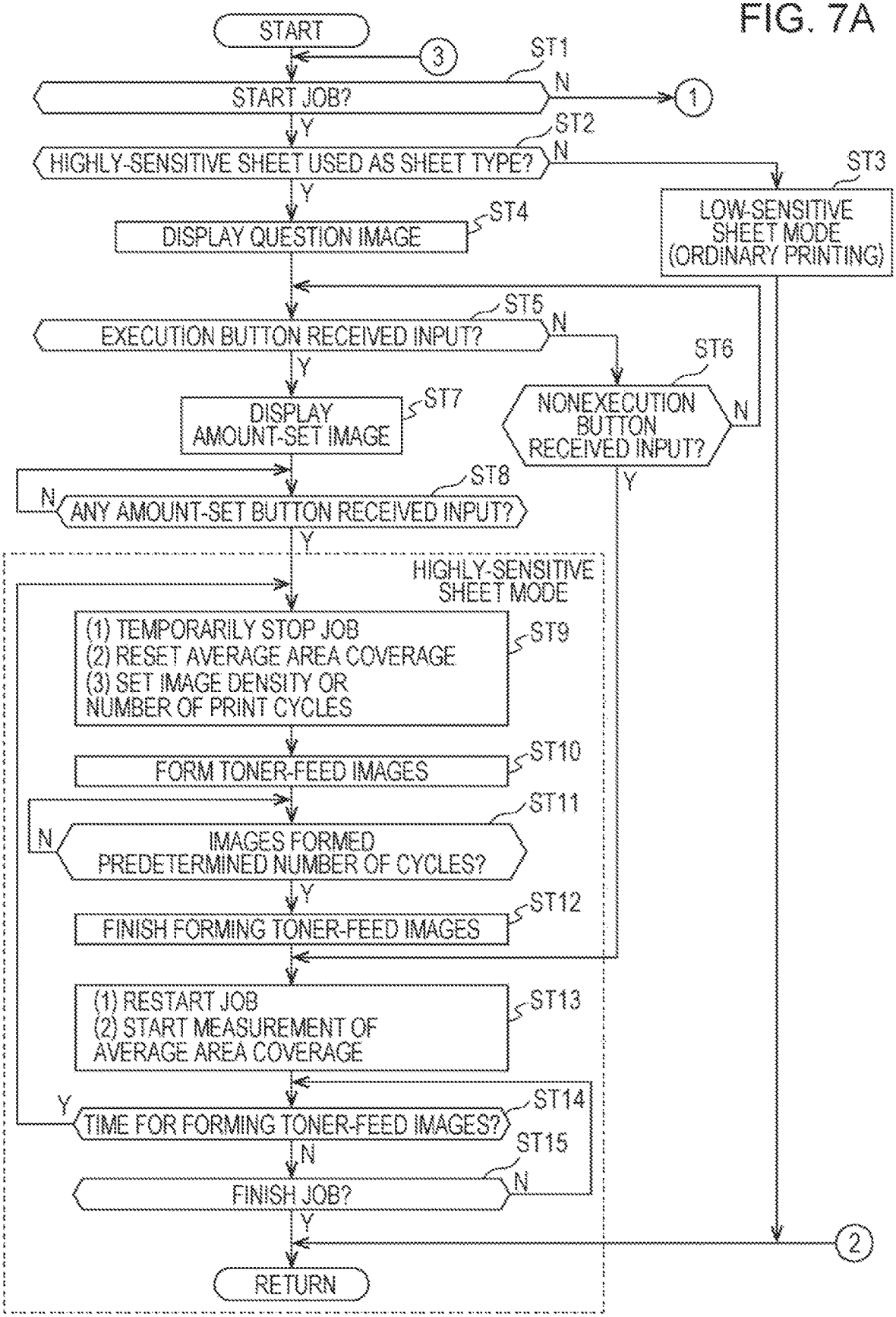
FIGS. 7A and 7B are flowcharts for forming toner-feed images of the example 1.
Figure 7B:
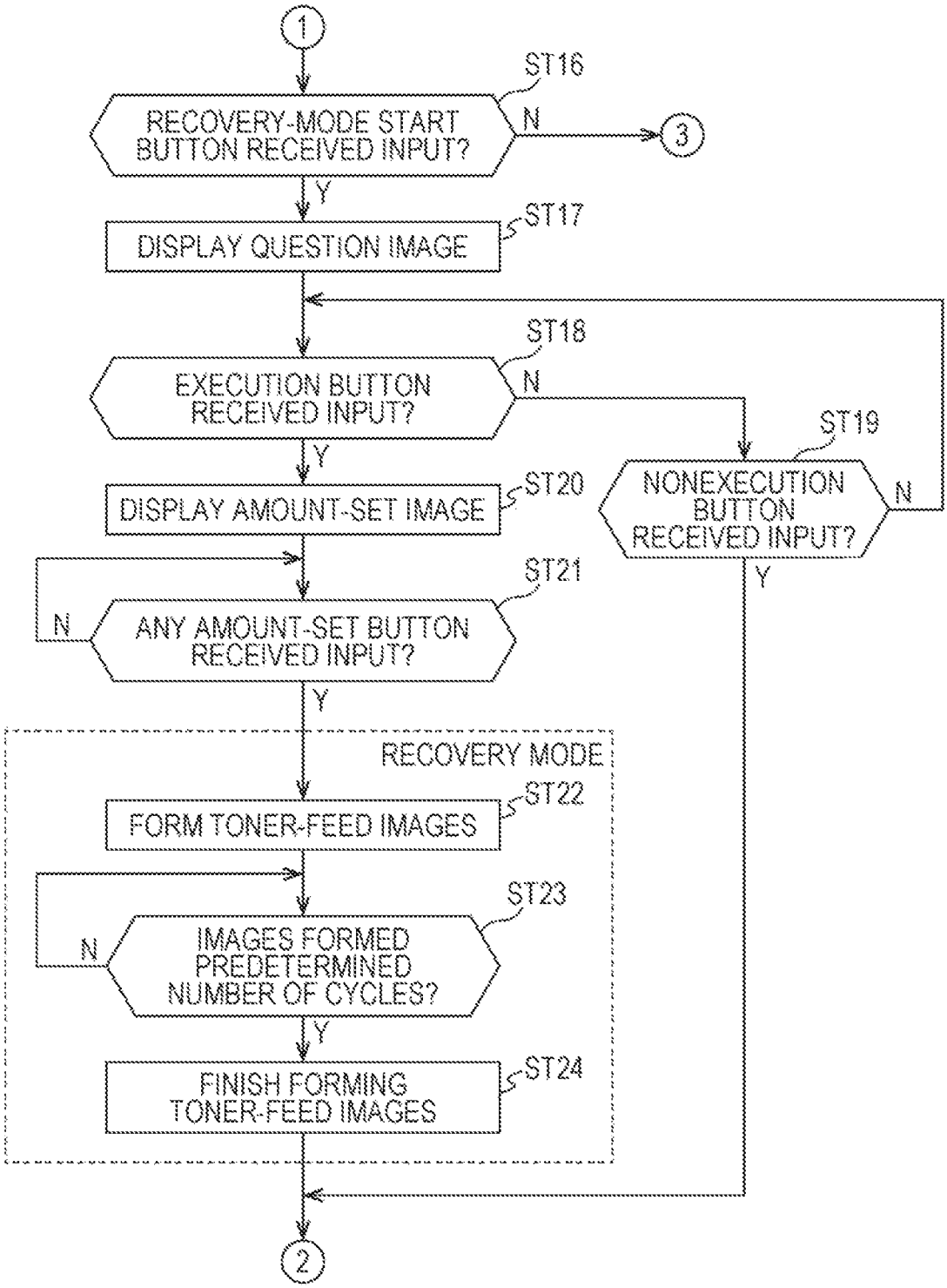

FIGS. 7A and 7B are flowcharts for forming toner-feed images of the example 1.

The process of each step ST in the flowcharts in FIGS. 7A and 7B is performed in accordance with a program stored in the controller C of the copying machine U. This process is executed concurrently with other processes of the copying machine U. Thus, the process of forming images on the recording sheet S in response to a job start is executed concurrently with the flowcharts in FIGS. 7A and 7B.

The flowcharts in FIGS. 7A and 7B are started by turning on the copying machine U.

In ST1 in FIG. 7A, whether a job is started is determined. If yes (Y), the process proceeds to ST2, and if no (N), the process proceeds to ST16.

In ST2, whether a recording sheet S for a job that is to be started is a highly-sensitive sheet is determined. If no (N), the process proceeds to ST3, and if yes (Y), the process proceeds to ST4.

In ST3, a low-sensitive sheet mode, serving as an example of a second forming mode, that is, an ordinary image forming operation is executed, and the process returns to ST1.

In ST4, the question image 111 is displayed on the display unit UIb. The process then proceeds to ST5.

In ST5, whether the execution button 112 receives an input is determined. If yes (Y), the process proceeds to ST7, and if no (N), the process proceeds to ST6.

In ST6, whether the nonexecution button 113 receives an input is determined. If yes (Y), the process proceeds to ST13, and if no (N), the process returns to ST5.

In ST7, the amount-set image 121 is displayed. The process then proceeds to ST8.

In ST8, whether any of the amount-set buttons 122 to 124 receives an input is determined. If yes (Y), the process proceeds to ST9, and if no (N), ST8 is repeated.

In ST9, the following processes (1) to (3) are executed, and the process proceeds to ST10:

(1) the job is temporarily stopped, or the job is left unstarted;

(2) the average area coverage is reset, or initialized; and (3) the toner consumption is set in accordance with the input to any of the amount-set buttons 122 to 124.

In ST10, the toner-feed images 1 with image density according to the set consumption are started to be formed. Specifically, the recovery mode is started. The process then proceeds to ST11.

In ST11, whether the toner-feed images 1 are formed the cycles corresponding to the set consumption is determined. If yes (Y), the process proceeds to ST12, and if no (N), ST11 is repeated.

In ST12, formation of the toner-feed images 1 is finished. The process then proceeds to ST13.

In ST13, the following processes (1) and (2) are executed and the process proceeds to ST14:

(1) the job is started or restarted; and (2) calculation of the average area coverage is started.

In ST14, whether it is time for forming toner-feed images is determined. If yes (Y), the job is temporarily stopped, and the process returns to ST9. If no (N), the process proceeds to ST15.

In ST15, whether the job is finished is determined. If yes (Y), the process returns to ST1. If no (N), the process returns to ST14.

In ST16, whether the recovery-mode start button UIc receives an input is determined. If yes (Y), the process proceeds to ST17, and if no (N), the process returns to ST1.

In ST17 to ST21, the processes similar to ST4 to ST8 are executed, and the process proceeds to ST22.

In ST22, the toner-feed images 1 with image density according to the set consumption are started to be formed. Specifically, the recovery mode is started. The process then proceeds to ST23.

In ST23, whether the toner-feed images 1 are formed the number of cycles corresponding to the set consumption is determined. If yes (Y), the process proceeds to ST24, and if no (N), ST23 is repeated.

In ST24, formation of the toner-feed images 1 is finished. Specifically, the recovery mode is finished. The process returns to ST1.

Operation of Example 1

When using a low-sensitive sheet, the copying machine U of the example 1 with the above structure forms images in a low-sensitive sheet mode. When using a highly-sensitive sheet, the copying machine U forms images in a highly-sensitive sheet mode including ST9 to ST15, as an example of a first forming mode.

Figure 8A:
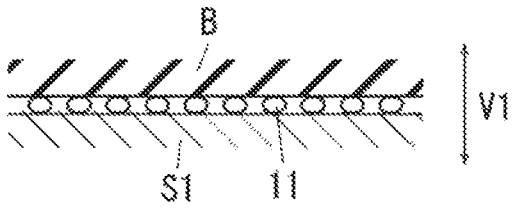
FIGS. 8A to 8C illustrate a voltage applied across a transfer area, where
Figure 8B:
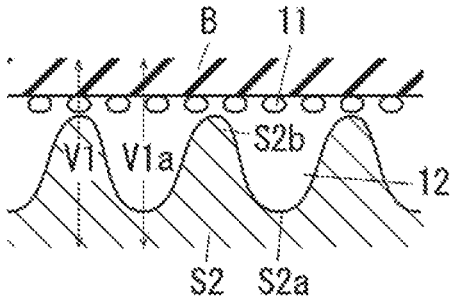
Figure 8C:
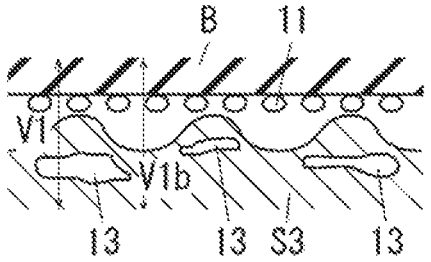

FIGS. 8A to 8C illustrate a voltage applied across a transfer area, where FIG. 8A illustrates an example where a low-sensitive sheet is used, FIG. 8B illustrates an example where an embossed sheet is used, and FIG. 8C illustrates an example where a Japanese paper sheet is used.

In FIG. 8A, to a low-sensitive sheet (second medium) S1 such as an ordinary sheet having a flat surface with scarcely any gap inside, a second transfer voltage V1 is substantially uniformly applied in a second transfer area Q4.

On the other hand, as illustrated in FIG. 8B, an embossed sheet S2, serving as an example of a highly-sensitive sheet (first medium), has an uneven surface, and gaps 12 are formed between recesses S2*a* of the embossed sheet S2 and the intermediate transfer belt B. Thus, the electrical resistance in the thickness direction varies between protrusions S2*b* without the gaps 12 and the recesses S2*a* with gaps 12. Electric discharge is thus more likely to occur in the gaps 12, and the second transfer voltage Via applied may be changed in the recesses S2*a*. Thus, transfer errors are more likely to occur in the recesses S2*a* than in the case of the low-sensitive sheet S1.

In FIG. 8C, a Japanese paper sheet S3, serving as an example of a highly-sensitive sheet, is more likely to have voids (gaps) 13 therein. As in the case of the embossed sheet S2, transfer errors are more likely to occur in a portion including the voids 13, than in a portion without the voids 13. Specifically, in addition to Japanese paper sheets, transfer errors are more likely to occur in recording sheets S with low density containing voids therein.

Using a highly-sensitive sheet thus has difficulty in toner transfer. Transfer is a phenomenon of movement of toner held on the intermediate transfer belt B to the recording sheet S with, for example, electrostatic force or adhesion. Toner transfer is facilitated with reduction of adhesion of toner to the intermediate transfer belt B.

The inventors have found through investigation that an application of the developer with the toner-feed images 1 in advance to an area of the intermediate transfer belt B where images are formed improves the transfer performance. Although the detailed principle is unknown, silicone oil, serving as an example of a release agent contained in the developer is assumed to be fed to the intermediate transfer belt B. When an image (print image) to be transferred to the recording sheet S is formed on the surface of silicone oil adhering to the intermediate transfer belt B, the adhesion of the developer forming the print image to the intermediate transfer belt B is assumed to be weakened by the silicone oil to improve the transfer performance also in the case of transfer to the highly-sensitive sheet.

Thus, in the example 1, when a print command of using a highly-sensitive sheet as the recording sheet S is received, the toner-feed images 1 are formed before forming an image to be transferred to the recording sheet S (image intended to be transferred to a medium). This weakens adhesion between the print image to be transferred to the recording sheet S and the intermediate transfer belt B. Thus, transfer errors are reduced compared to an existing structure where the toner-feed images 1 are not formed in advance.

EXPERIMENTAL EXAMPLES

Experiments are performed to check the effects of the present disclosure.

Experimental Example 1

In an experimental example 1, adhesion of the developer is measured in an image portion, which receives an image, and a no-image portion, which receives no image, of the intermediate transfer belt B. In this experiment, adhesion is measured in a state where no toner-feed image 1 is formed (state before recovery mode) and in a state where the toner-feed images 1 are formed in an area corresponding to the image portion and in an area corresponding to the no-image portion (state after recovery mode in ST12 and ST24).

To measure adhesion, the intermediate transfer belt B to which the developer adheres is stopped, air is blown on the developer, and air pressure (wind pressure) blown on the developer when the developer is blown away is visually checked to find an adhesion index (Pa).

Figure 9:
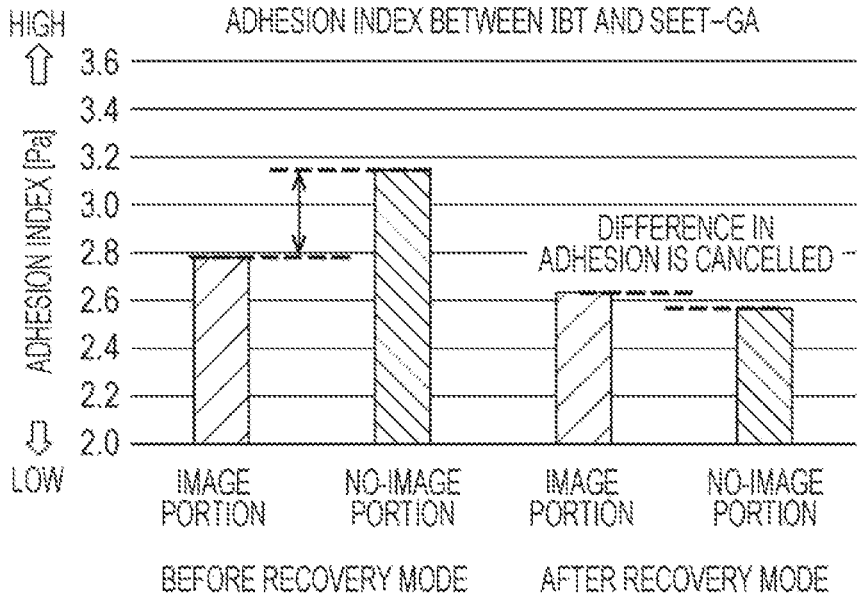
FIG. 9 is a graph showing the results of adhesion experiments of a developer on the intermediate transfer belt, with the vertical axis corresponding to the adhesion.

FIG. 9 shows the results of experiment.

FIG. 9 is a graph showing the results of experiments of developer adhesion to the intermediate transfer belt, with the vertical axis corresponding to the adhesion.

In FIG. 9, before execution of the recovery mode, the no-image portion has high adhesion. After the recovery mode in which the toner-feed images 1 are fed, the adhesion is reduced. The image portion has also reduced adhesion after the recovery mode compared to before the recovery mode. After the recovery mode, the difference in adhesion between the image portion and the no-image portion is cancelled.

Figure 10:
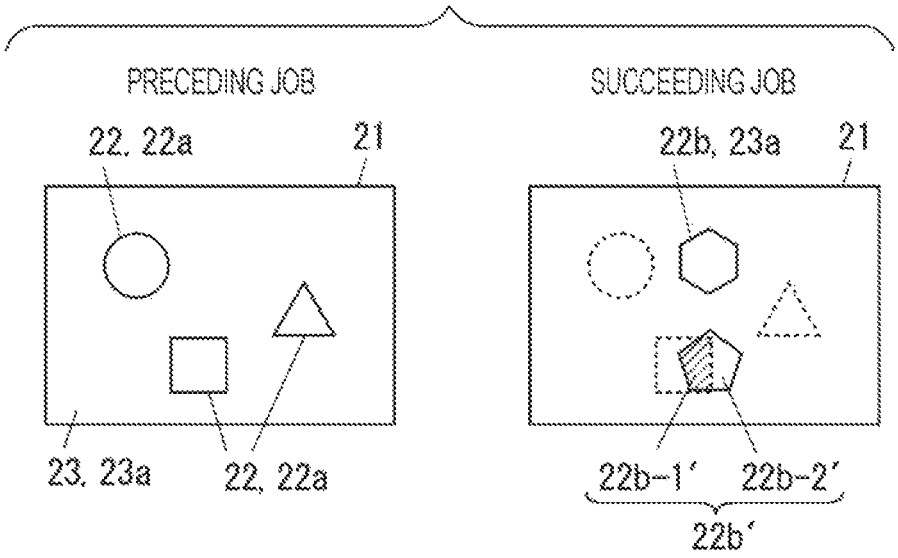
FIG. 10 illustrates the relationship between an example of an image intended to be transferred to a medium, and a toner-feed image.

FIG. 10 illustrates the relationship between an example of an image intended to be transferred to a medium, and a toner-feed image.

In FIG. 10, an image area 21 in a single page includes areas 22, to which the developer including characters, drawings, or photos is transferred, and an area 23, to which no developer is transferred. In a preceding job, an area 23*a* on the intermediate transfer belt B to which no developer is transferred has high adhesion, as in the state of the no-image portion before the recovery mode in FIG. 9. Thus, in FIG. 10, when the area 23*a* to which no developer is transferred in the preceding job is changed to a developer-receiving area 22*b* in a succeeding job, the adhesion of the developer may be so high as to cause transfer errors. When an area 22*b*' to which a developer is transferred in a succeeding job includes an area 22*b*-1', which overlaps an area 22*a* to which the developer is transferred in the preceding job, and an area 22*b*-2', which overlaps the area 23*a* to which no developer is transferred in the preceding job, a transfer error may partially occur due to the difference in adhesion to clarify the image quality defect unless the recovery mode is executed.

In the example 1, on the other hand, to use a highly-sensitive sheet in the succeeding job, the toner-feed images 1 are formed before the succeeding job when an input of execution of the recovery mode is received through the question image 111. Thus, as in the case of after the recovery mode in FIG. 9, the succeeding job is executed after the adhesion of the developer is reduced and the difference in adhesion is cancelled. Thus, transfer errors are reduced in the succeeding job where a highly-sensitive sheet is used.

In the example 1, to use a highly-sensitive sheet, the toner-feed images 1 are formed. This structure enables reduction of developer consumption as a whole, compared to a structure where the toner-feed images 1 are formed also in the case of a low-sensitive sheet for which the toner-feed images 1 are not to be formed.

In the example 1, the recovery mode is not executed when the nonexecution button 113 in the question image 111 receives an input also when a highly-sensitive sheet is used. Specifically, the recovery mode is not executed when a user determines not to execute the recovery mode because of reasons such as the number of sheets to be printed is small or to save the stand-by time that would be caused by executing the recovery mode. Thus, in the example 1, a user is allowed to select and make an input whether to execute the recovery mode or not, unlike in the structure where the recovery mode is executed anytime when the condition for executing the process of recovering the transfer performance of the intermediate transfer belt B is satisfied. When the recovery process is executed anytime when the condition is satisfied, productivity is reduced while image formation is disabled during the execution of the recovery mode. In contrast, productivity is improved in the example 1 where the question image 111 is displayed to allow a user to select the execution.

In the example 1, besides when a highly-sensitive sheet is used, the toner-feed images 1 are formed in response to an input through, for example, the question image 111, also when the average area coverage fails to arrive at a predetermined area coverage or when the average area coverage has a large difference in the width direction. When image formation at low area coverage is continued, adhesion between the intermediate transfer belt B and the developer increases, and more likely to cause transfer errors. When the average area coverage has a difference in the width direction, transfer errors are more likely to be conspicuous due to the variance of adhesion increase, if the amount of the fed developer varies in the width direction, as in the case of printed matter containing a photo on one side and characters on the other side.

In the example 1, in contrast, regardless of an increase of adhesion of the developer with image formation, adhesion is reduced again through formation of the toner-feed images 1. Even in continuous printing of a large number of sheets, transfer errors are stably reduced in the first half and the second half of the printing. In addition, the toner-feed images 1 may be formed through an input to the recovery-mode start button UIc displayed through the question image 111. Thus, a user may manually start the recovery mode as appropriate through checking of the quality of the printed image. This structure is thus capable of flexibly responding to a request of a user compared to the structure unable to accept manual start.

In the example 1, a user is allowed to set developer consumption in the recovery mode with an input to the amount-set image 121. When an operation of the recovery mode is a uniform operation of printing an image a specific number of times at specific image density, printing of an image intended to be transferred is disabled for a specific period after the start of the recovery mode, and a predetermined amount of the developer is consumed. However, from the factors such as a user's check on printed matter, consideration of the number of remaining sheets, temperature, or humidity, a user may determine that the image quality may be fully recovered without completely executing the recovery mode. To address this, the example 1 allows a user to set developer consumption through the amount-set image 121, so that the recovery mode may be shortened to reduce developer consumption. Conversely, when the image quality degrades significantly, and a user desires execution of the recovery mode more carefully than usual (medium level), the recovery mode may be executed for a longer period to consume more developer. This structure thus allows a user to set the time length of the recovery mode or the developer consumption. Thus, a user is allowed to shorten the recovery mode to increase the number of times of printings per unit time, allowed to reduce the developer consumption in the recovery mode, and allowed to improve the image quality by elongating the recovery mode at high density, to improve the productivity.

In the example 1, an image covering the entirety of the image area 2 is used as the toner-feed image 1. Compared to the case where the areas 22 to which the image is transferred or the area 23 to which no image is transferred in the preceding job or the succeeding job are stored or calculated, this image covering the entirety further reduces the process load without the need of storage or calculation of the areas 22 and 23. In addition, this image stably reduces adhesion of the entirety of the image area 2 regardless of the properties such as frequency or size of the areas 22 and 23.

In the example 1, the toner-feed images 1 are formed while the intermediate transfer belt B rotates multiple cycles. When the intermediate transfer belt B rotates only one cycle, the fed release agent of the developer may be insufficient. However, when the toner-feed images 1 are fed while the intermediate transfer belt B rotates multiple cycles, the release agent is fully fed. This structure thus stably reduces transfer errors.

In the example 1, while the intermediate transfer belt B rotates multiple cycles, the toner-feed images 1 are formed at portions corresponding to the inter-image areas 3. Thus, the adhesion is uniformly reduced throughout the surface of the intermediate transfer belt B.

Modification Example of Toner-Feed Image

Figure 11A:
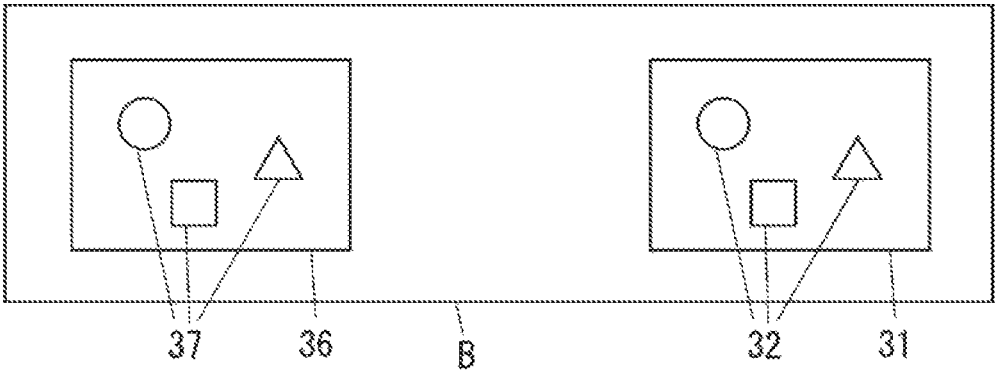
FIGS. 11A, 11B, and 11C illustrate toner-feed images according to a modification example, where
Figure 11B:
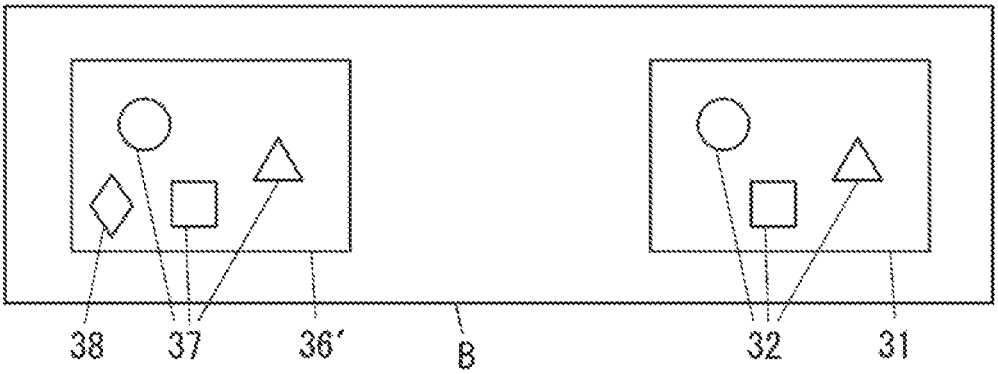
Figure 11C:
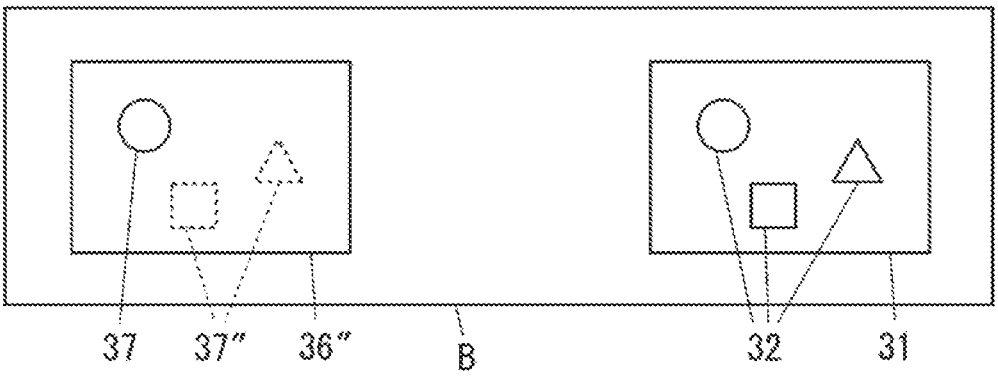

FIGS. 11A, 11B, and 11C illustrate toner-feed images according to a modification example, where FIG. 11A illustrates a case where a toner-feed image corresponds to all the images intended to be transferred, FIG. 11B illustrates a case where a toner-feed image is also formed at a position different from an image intended to be transferred, and FIG. 11C illustrates a case where toner-feed images correspond to some of images intended to be transferred.

In the example 1, the toner-feed image 1 is an image covering the entirety of the image area 2, that is, an image covering the entirety of the image intended to be transferred, but this is not the only possible example.

As illustrated in FIG. 11A, a toner-feed image 36, which feeds the developer to portions 37 corresponding to all image portions 32 in an image 31 in the succeeding job, may be formed. The toner-feed image 36 as illustrated in FIG. 11A reduces adhesion of the developer at the image portions 32 at which the image quality may be affected when transfer errors occur. Thus, an image to be transferred to the recording sheet S would have no problem. Compared to the case of the example 1, consumption of the developer forming the toner-feed images 36 is reduced.

In FIG. 11B, a toner-feed image 36', which feeds the developer to a portion 38 different from the image portions 32 besides the portions 37 corresponding to all the image portions 32 in the image 31 in the succeeding job, may be formed. For example, the toner-feed image 36' feeds the developer to the portion 38 different from the image portions 32 when no image has been formed at the portion 38 for a long time in the past jobs to excessively increase adhesion to such a level that a single application of the toner-feed image 1 is not enough to reduce the adhesion. This operation prevents an excessive increase of adhesion of the developer.

In FIG. 11C, a toner-feed image 36", which feeds the developer to at least one portion 37 corresponding to any of the image portions 32 in the image 31 of the succeeding job, may be formed. Specifically, the toner-feed image 36", which includes portions 37" corresponding to the image portions 32 but to which no developer is fed, may be formed. For example, when images are continuously fed to the portions 37" in the past jobs and the adhesion is fully reduced, the developer fed to the portion 37" may be highly likely to be useless. Thus, the toner-feed image 36" in which no developer is fed to the portions 37 may be formed. Thus, useless developer consumption is reduced.

MODIFIED EXAMPLES

Thus far, the examples of the present disclosure have been described in detail. However, the disclosure is not limited to the above-described examples, and may be modified in various manners within the scope of the gist of the present disclosure described in the scope of claims. Modified examples H01 to H08 of the present disclosure are described, below, by way of examples.

H01

In the above examples, a copying machine U is described as an example of an image forming apparatus, but the present disclosure is not limited to this. The present disclosure is applicable to, for example, a FAX machine, or a multifunctional device including multiple functions such as a FAX machine, a printer, and a copying machine. The image forming apparatus is not limited to a multi-color image forming apparatus, and may be a monochrome image forming apparatus.

H02

In the above examples, specific numerical values specified by way of example may be changed as appropriate in accordance with a change of design or specifications.

H03

In the above examples, a case where the toner-feed images 1 are formed for a highly-sensitive sheet has been described, but this is not the only possible example. The toner-feed images 1 may also be formed for a low-sensitive sheet. In addition, the toner-feed images 1 may be formed in accordance with an image in a succeeding job when adhesion of the developer increases, for example, in the case of a high humid, when the ratio of the degraded developer is increased, or when an image carrier unit such as the intermediate transfer belt B degrades with time.

H04

In the above examples, the recovery mode in which the toner-feed images 1 are formed is preferably executed in response to an input to the recovery-mode start button UIc.

However, the recovery mode may not be executed without providing the recovery-mode start button UIc.

H05

In the above examples, examples of the toner-feed images are illustrated in FIGS. 6 and 11A to 11C, but these are not the only possible examples. For example, when the image portion includes characters, the toner-feed image may be changed as appropriate, such as a rectangular image surrounding the characters, an image larger than the image portion 32, or an image with a specific shape such as a circle or polygon including the image portion 32. The properties of the image such as the color or density may also be changed as appropriate.

H06

In the above examples, specific display contents such as the question image 111 or the amount-set image 121 are not limited to the examples described as above, and may be changed as appropriate.

H07

In the above examples, the question image 111 or other images are displayed on the display unit UIb of the user interface UI, but these are not the only possible examples. For example, when printing is instructed from, for example, a personal computer, a printer server, or a smartphone connected to the image forming apparatus, the question image 111 may be displayed on a display, serving as a display unit of a personal computer. Similarly, instead of setting the type of a medium (ordinary sheet, embossed sheet, or other sheets) through the user interface UI, the type of a medium may be set through, for example, a personal computer.

H08

In the above examples, the average area coverage is used as an example of toner consumption information, but this is not the only possible example. For example, actual toner consumption (=average area coverage×total area) may be used, instead. Instead of calculating detailed consumption, rough consumption tendency may be acquired as toner consumption information. In this case, for example, as toner consumption information, the number of times the image density fails to arrive at a predetermined threshold (number of times of low density) may be counted, the area in the printed area to the total area may be calculated, or printing attributes (whether the image is formed from "characters" with small consumption or "images" with large consumption) of each image may be used.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus, comprising:

an image carrier unit that holds images formed from a developer, the images including an image intended to be transferred to a medium and an image unintended to be transferred to the medium;

an image display control unit that causes a display unit to display an image asking whether the image unintended to be transferred is to be formed when a predetermined condition for forming the image unintended to be transferred is satisfied; and a forming unit that forms the image unintended to be transferred to the medium when a command of forming the image unintended to be transferred to the medium is input to a display on the display unit.

2. The image forming apparatus according to claim 1, wherein the image display control unit determines that the condition for forming the image unintended to be transferred is satisfied when a medium to which the image intended to be transferred is to be transferred is a highly transfer-sensitive medium, and causes the display unit to display the image asking whether the image unintended to be transferred is to be formed.

3. The image forming apparatus according to claim 2, wherein the highly transfer-sensitive medium is formed from an embossed sheet or a Japanese paper sheet.

4. The image forming apparatus according to claim 3, wherein whether the condition for forming the image unintended to be transferred is satisfied is determined based on toner consumption information from a history of formerly formed images intended to be transferred.

5. The image forming apparatus according to claim 4, wherein the toner consumption information includes average area coverage, and the condition for forming the image unintended to be transferred is determined as being satisfied when the average area coverage falls below a predetermined threshold.

6. The image forming apparatus according to claim 4, wherein the condition for forming the image unintended to be transferred is determined as being satisfied when a difference in average area coverage, serving as the toner consumption information, between a plurality of areas arranged in a width direction arrives at a predetermined threshold, the width direction crossing a direction in which the medium is transported.

7. The image forming apparatus according to claim 2, wherein whether the condition for forming the image unintended to be transferred is satisfied is determined based on toner consumption information from a history of formerly formed images intended to be transferred.

8. The image forming apparatus according to claim 7, wherein the toner consumption information includes average area coverage, and the condition for forming the image unintended to be transferred is determined as being satisfied when the average area coverage falls below a predetermined threshold.

9. The image forming apparatus according to claim 7, wherein the condition for forming the image unintended to be transferred is determined as being satisfied when a difference in average area coverage, serving as the toner consumption information, between a plurality of areas arranged in a width direction arrives at a predetermined threshold, the width direction crossing a direction in which the medium is transported.

10. The image forming apparatus according to claim 1, wherein whether the condition for forming the image unintended to be transferred is satisfied is determined based on toner consumption information from a history of formerly formed images intended to be transferred.

11. The image forming apparatus according to claim 10, wherein the toner consumption information includes average area coverage, and the condition for forming the image unintended to be transferred is determined as being satisfied when the average area coverage falls below a predetermined threshold.

12. The image forming apparatus according to claim 11, wherein the condition for forming the image unintended to be transferred is determined as being satisfied when a difference in average area coverage, serving as the toner consumption information, between a plurality of areas arranged in a width direction arrives at a predetermined threshold, the width direction crossing a direction in which the medium is transported.

13. The image forming apparatus according to claim 10, wherein the condition for forming the image unintended to be transferred is determined as being satisfied when a difference in average area coverage, serving as the toner consumption information, between a plurality of areas arranged in a width direction arrives at a predetermined threshold, the width direction crossing a direction in which the medium is transported.

14. The image forming apparatus according to claim 1, wherein the forming unit increases or decreases an area of the image unintended to be transferred to increase or decrease consumption of the developer.

15. The image forming apparatus according to claim 1, wherein the forming unit increases or decreases density of the image unintended to be transferred to increase or decrease consumption of the developer.

16. The image forming apparatus according to claim 1, wherein the forming unit forms the image unintended to be transferred to the medium during a period while the image carrier unit rotates a plurality of cycles.

17. The image forming apparatus according to claim 16, wherein the image unintended to be transferred to the medium has a predetermined length in a rotation direction of the image carrier unit.

18. The image forming apparatus according to claim 17, wherein the forming unit forms the images unintended to be transferred to the medium with a gap in between, and wherein the forming unit forms the images unintended to be transferred to the medium in an area overlapping the gap in a second or subsequent cycle of the image carrier unit.

19. An image forming apparatus, comprising:

an image carrier unit that holds images formed from a developer, the images including an image intended to be transferred to a medium and an image unintended to be transferred to the medium;

an image display control unit that causes a display unit to display an image for setting an amount of the developer used for the image unintended to be transferred when a predetermined condition for forming the image unintended to be transferred is satisfied; and a forming unit that forms the image unintended to be transferred to the medium based on an amount of the developer set through a display on the display unit.

20. An image forming apparatus, comprising:

image carrier means for holding images formed from a developer, the images including an image intended to be transferred to a medium and an image unintended to be transferred to the medium;

image display control means for causing display means to display an image asking whether the image unintended to be transferred is to be formed when a predetermined condition for forming the image unintended to be transferred is satisfied; and forming means for forming the image unintended to be transferred to the medium when a command of forming the image unintended to be transferred to the medium is input to a display on the display means.

* * * * *